US006793332B2

(12) United States Patent
Kaga et al.

(10) Patent No.: US 6,793,332 B2
(45) Date of Patent: Sep. 21, 2004

(54) INK HOUSING DEVICE EFFECTIVELY PREVENTING INK LEAKAGE

(75) Inventors: Hikaru Kaga, Aichi-ken (JP); Katsunori Nishida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/266,672

(22) Filed: Oct. 9, 2002

(65) Prior Publication Data

US 2003/0067521 A1 Apr. 10, 2003

(30) Foreign Application Priority Data

Oct. 9, 2001 (JP) ..... P2001-311930

(51) Int. Cl.[7] ..... M41J 2/175
(52) U.S. Cl. ..... 347/86; 347/36
(58) Field of Search ..... 347/36, 85, 86, 347/87

(56) References Cited

U.S. PATENT DOCUMENTS 5,157,421 A * 10/1992 Kitahara ..... 347/86
5,221,935 A * 6/1993 Uzita ..... 347/36
5,801,737 A * 9/1998 Sato et al. ..... 347/86
6,135,590 A * 10/2000 Saeki et al. ..... 347/86
6,281,911 B1 * 8/2001 Nakazawa et al. ..... 347/36

FOREIGN PATENT DOCUMENTS

JP A 4-211963 8/1992

* cited by examiner

*Primary Examiner*—Anh T.N. Vo
(74) *Attorney, Agent, or Firm*—Oliff & Berridge, PLC

(57) ABSTRACT

A casing of an ink cartridge is formed with an accommodating chamber for accommodating an ink accommodating pouch and a waste ink introducing chamber into which waste ink from print heads is discharged. A stepped opening formed penetrating through a cover is sealed off with an air permeable film. One end of a labyrinth channel formed in the cover is fluidly connected to the stepped opening outside the air permeable film. Another end of the labyrinth channel is exposed to ambient air through a hole formed in an air non-permeable film that is placed over both the stepped opening and the labyrinth channel.

15 Claims, 5 Drawing Sheets

INK HOUSING DEVICE EFFECTIVELY PREVENTING INK LEAKAGE

BACKGROUND OF THE INVENTION

1. Field of the Invention

The present invention relates to an ink housing device for supplying ink to a recording head and also to an inkjet recording device including the ink housing device.

2. Related Art

Japanese Patent No. 2725281 discloses a conventional ink housing device used in an inkjet recording device that ejects ink droplets onto a recording medium in accordance with input signals. The ink housing device includes an air-tight box-shaped ink cartridge whose internal space is divided into two chambers. An ink accommodating pouch made of compound resin is housed in one chamber, and a waste ink absorbing member is housed in another chamber. A sidewall of the one chamber is formed with a through hole into which a rubber stopper is inserted. The rubber stopper seals off one end of an ink outlet tube extending from the ink accommodating pouch. An ink supply needle that is connected through a supply tube to a recording head is penetrating the rubber stopper into the ink outlet tube. With this configuration, ink inside the ink accommodating pouch is supplied to the recording head through the ink outlet tube, the needle, and the supply tube.

One side wall of the another chamber is formed with a through hole, into which a waste-ink inlet made of resilient rubber is inserted. A discharging needle attached to a tip end of a waste ink tube that is connected to a purging member is penetrating through the waste-ink inlet to locate near the waste ink absorbing member. With this condition, defective ink and air bubbles drawn out of the recording head during purging operations are collected into the another chamber through the waste ink tube and the discharging needle. Thus collected ink is absorbed into the waste ink absorbing member, and collected air is discharged out of the chamber through a discharge port formed in an upper wall of the another chamber.

Japanese Patent Application-Publication No. HEI-4-211963 discloses a different type of ink housing device that includes a box-shaped air-tight cartridge casing. A waste-ink absorbing member, a non-absorbing sheet (a sheet that does not absorb liquid) positioned along a wide upper surface of the waste-ink absorbing member, and an ink accommodating pouch that accommodates ink are all housed inside the casing. A sealing cap made of resilient rubber is engaged inside a through hole formed in a side wall of the casing, and is connected to a tube housed inside the ink accommodating pouch. An ink discharging tube is inserted through a sidewall into the casing so that its leading end locates above the non-absorbing sheet. When waste ink is introduced through the ink discharging tube and dropped onto the non-absorbing member, then the ink quickly spreads along its surface and then absorbed into the ink absorbing member. Air bubble collected into the casing would be discharged through a port.

SUMMARY OF THE INVENTION

However, according to the above-described conventional ink housing devices, the ink absorbing member and the non-absorbing sheet increase production costs of the device. Also, when the ink absorbing member with waste ink absorbed therein is left for a long period of time, then volatile materials of ink evaporate, so that the ink solidifies inside the ink absorbing member. The solidified ink prevents capillary effect of the ink absorbing member on its surface. Further, if air bubbles reside inside the casing, internal pressure of the casing increases, so that waste ink leaks out of the casing through the through holes, thereby dirtying internal of an inkjet recording device.

Moreover, when the through holes are faced downward by tilting or turning an ink cartridge upside down while handling the ink cartridge, then waste ink more easily leaks out of the casing.

In view of foregoing, it is an object of the present invention to overcome the above problems and also to provide an inexpensive ink housing device preventing ink leakage without using an ink absorbing member and also to provide an inkjet recording device including the ink housing device.

In order to overcome the above and other objects, according to the present invention, there is provided an ink housing device including a casing and an air permeable film. The casing is formed with an ink accommodating chamber for accommodating an ink accommodating pouch and a waste ink chamber into which a waste ink is collected. The casing is formed with a through hole connected to the waste ink chamber. The air permeable film seals the through hole.

There is also provided an inkjet recording device an inkjet head, an ink cartridge, a supply tube, and a discharging tube. The ink cartridge includes an ink accommodating pouch accommodating ink, a casing formed with a waste ink chamber and an ink accommodating chamber that houses the ink accommodating pouch, and an air permeable film. The casing is formed with a through hole connected to the waste ink chamber. The air permeable film seals the through hole. The supply tube introduces the ink from the ink accommodating pouch to the inkjet head. The discharging tube introduces waste ink from the inkjet head into the waste ink chamber.

BRIEF DESCRIPTION OF THE DRAWINGS

In the drawings:

FIG. 4(*b*) is a perspective view showing a process of producing the sheet folded in half;

FIG. 4(*c*) is a perspective view showing a process of producing the sheet whose side edges are adhered;

FIG. 4(*d*) is a perspective view of an ink is accommodating pouch;

PREFERRED EMBODIMENT OF THE PRESENT INVENTION

Next, an inkjet recording device according to an embodiment of the present invention will be described while referring to the attached drawings.

Figure 1:
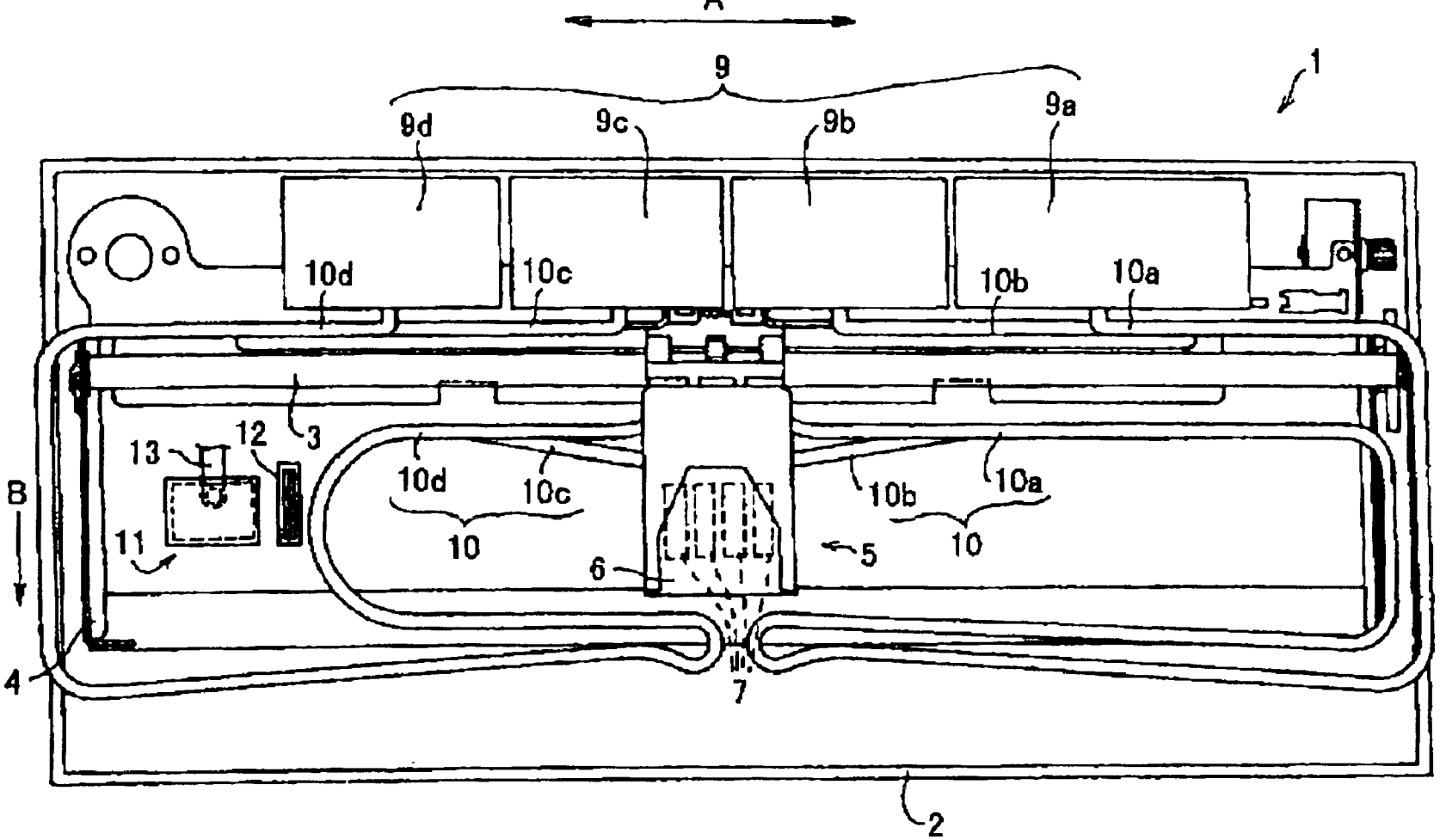
FIG. 1 is a plan view showing overall configuration of an inkjet recording device according to an embodiment of the present invention.

First, an overall configuration of an inkjet recording device 1 will be described with reference to FIG. 1. As shown in FIG. 1, the inkjet recording device 1 includes a main case 2, a guide rail 3, a frame 4, a carriage 5, and a head unit 6. The frame 4 is disposed inside the main case 2. The guide rail 3 extends in a widthwise direction indicated by an arrow A, and both lengthwise ends of the guide rail 3 are fixed in the frame 4. The carriage 5 is mounted on the guide rail 3. A driving mechanism including a timing belt, a drive motor, and the like (not shown) reciprocally moves the carriage 5 in the widthwise direction A along the guide rail 3 over a prescribed interval. The head unit 6 is detachably mounted in the bottom of the carriage 5, and includes four print heads 7 arranged in a row for ejecting four colors of ink. Each print head 7 is formed with a plurality of ejection channels in a bottom. Although not shown in the drawing, the inkjet recording device 1 further includes a transporting mechanism that transports a recording sheet in a sheet feed direction indicated by an arrow B along a predetermined sheet feed path.

Four ink cartridges 9*a*, 9*b*, 9*c*, 9*d* (hereinafter collectively referred to as "ink cartridges 9") are disposed side by side below the sheet feed path. Each ink cartridge 9 accommodates one of four colors of ink, i.e., magenta, yellow, cyan, and black. Ink supply lines 10*a*, 10*b*, 10*c*, 10*d* (collectively referred to as "supply lines 10") are formed of a synthetic resin or other material having flexibility. Each ink supply line 10 includes a base end mounted with a pointed hollow needle 29 shown in FIG. 6, and an opposite end connected to one of four joints (not shown) of the carriage 5. The needle 29 is inserted into the ink cartridge 9 in a manner describe later. With this configuration, the ink supply lines 10 fluidly connect the ink cartridges 9 to the corresponding print heads 7 via the carriage 5 for supplying ink from the ink cartridges 9 to the print heads 7.

A suction cap 11, a wiper blade 12, and a suction pipe 13 are disposed on the left end in the main case 2 (within a moving range of the carriage 5) so as to confront the print heads 7 when the carriage 5 is located at a predetermined purging position. The wiper blade 12 is for wiping a nozzle surface of each print head 7 when the carriage 5 is moved to the purging position. The suction cap 11 is for covering the nozzle surfaces of the print heads 7 to form a close seal during purging operations. The suction pipe 13 is connected to the suction cap 11 at one end and mounted with a pointed hollow needle 28 shown in FIG. 5 on an opposite end.

Figure 2:
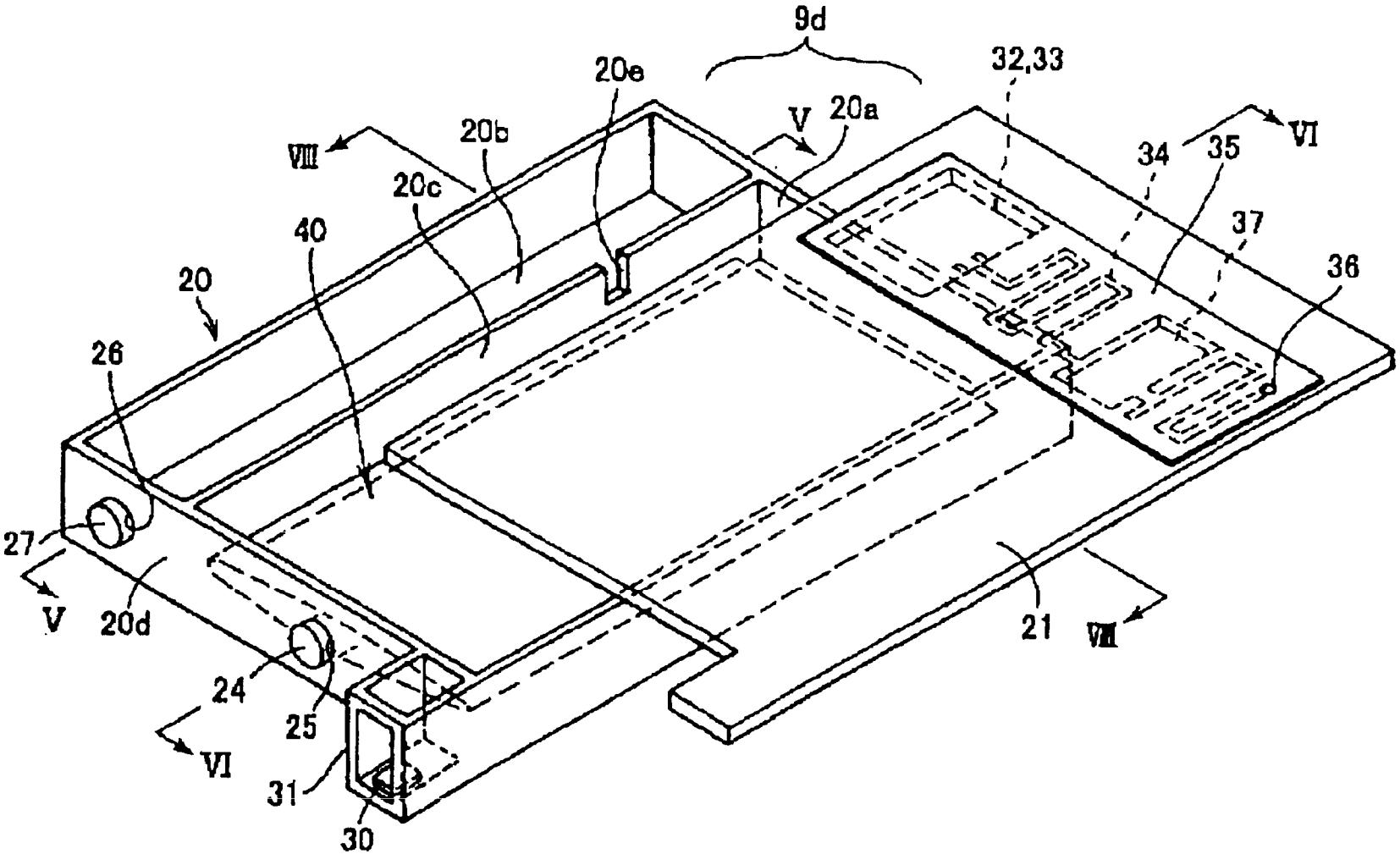
FIG. 2 is an exploded perspective view of an ink cartridge for black ink used in the inkjet recording device of FIG. 1.

Next, configuration of the ink cartridge 9*d* for black ink, which is the most commonly used ink, will be described. As shown in FIG. 2, the ink cartridge 9*d* includes a flat box-like casing 20, a cover 21 for covering a top surface of the casing 20, and an ink accommodating pouch 40 disposed inside the casing 20. The casing 20 is formed of a synthetic resin material to approximately rectangular in shape. The casing 20 is partitioned into an accommodating chamber 20*a* and a waste ink introducing chamber 20*b* having a smaller volume than the accommodating chamber 20*a* by a partitioning wall 20*c*. The accommodating chamber 20*a* accommodates the ink accommodating pouch 40.

A left side wall 20*d* of the casing 20 is formed with a mounting hole 25 and a connection hole 26, which a sealing member 24 and a sealing member 27 are inserted into and seal off, respectively.

Here, although not shown in the drawings, the ink cartridges 9*a*, 9*b*, 9*c* have the similar configuration as that of the ink cartridge 9*d* with exception that the ink cartridges 9*a*, 9*b*, 9*c* do not necessarily include the partitioning wall 20*c*, i.e., the waste ink introducing chamber 20*b*.

The ink accommodating pouch 40 accommodates ink for supplying to a corresponding one of the print heads 7 that is an print head 7 for black ink in this example, and as shown in FIG. 4(*d*), the ink accommodating pouch 40 includes an ink extraction outlet 23 and the sealing member 24 engaged with the ink extraction outlet 23.

Figure 6:
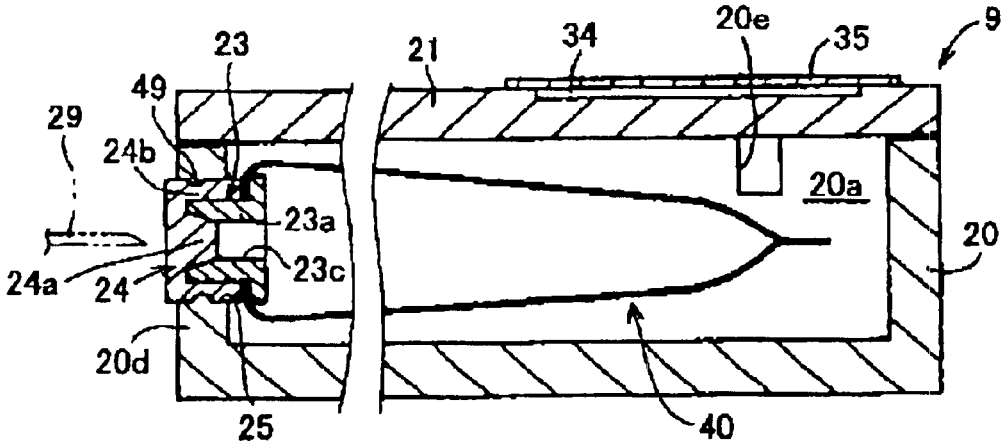
FIG. 6 is a cross-sectional view of the ink cartridge taken along a line VI—VI of FIG. 2 with the cover placed on the casing.

The needle 29 shown in FIG. 6 that is connected to the print head 7 via the ink supply tube 10 is inserted through the sealing member 24 and the ink extraction outlet 23 into the ink accommodating pouch 40. With this configuration, the ink accommodated in the ink accommodating pouch 40 is supplied to the corresponding print head 7 through the needle 29, the ink supply tube 10, and the carriage 5.

Figure 5:
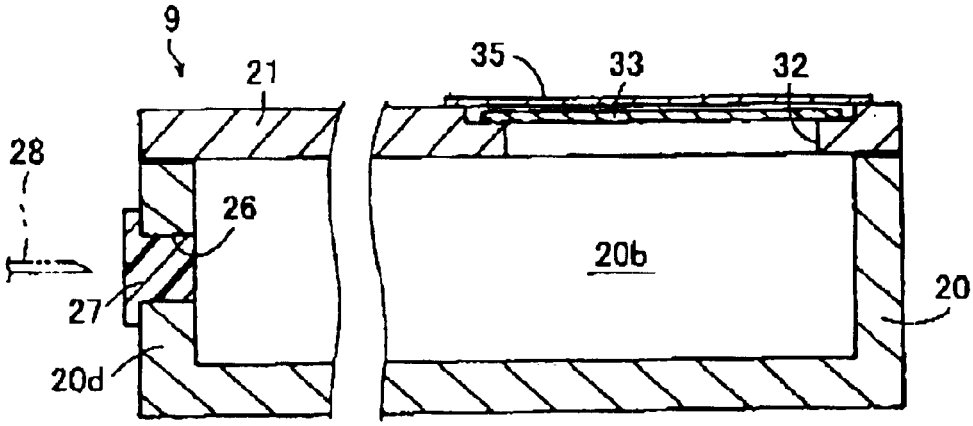
FIG. 5 is a cross-sectional view of the ink cartridge taken along a line V—V of FIG. 2 with a cover placed on a casing.

Also, the needle 28 shown in FIG. 5 that is connected through the suction pipe 13 to the purging cap 11 is inserted through the sealing member 27 into the waste ink introducing chamber 20*b*. With this configuration, waste ink drawing out of the print heads 7 during the purging operations is discharged into the waste ink introducing chamber 20*b* along with air bubbles contained in the ink.

The defective ink collected into the waste ink introducing chamber 20*b* in this manner is introduced into the accommodating chamber 20*a* through a connection port 20*e* formed in the partitioning wall 20*c* when the volume of the ink accommodating pouch 40 decreases as ink is expended. Therefore, the waste ink introducing chamber 20*b* do not need a large volume, so that the ink cartridge 9*d* can have a compact size.

The sealing members 24 and 27 are formed of an elastic member, such as silicon rubber, urethane rubber, nitrile rubber (NBR), isoprene rubber, butylenes rubber, or fluorine rubber. Since it is desirable that the needles 29, 28 be able to penetrate through the sealing members 24, 27, respectively, and that the hole in the sealing members 24 and 27 left when the needles 29 and 28 are removed therefrom be hermetically resealed by the elasticity of the rubber material of the sealing members 24 and 27, a silicon gum with high resilient restoration is preferable for the material to form the sealing members 24 and 27.

Figure 7:
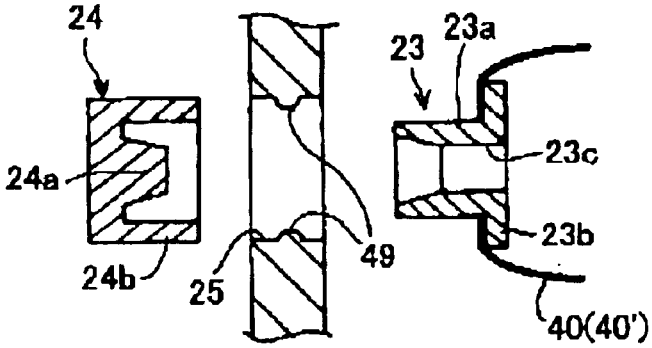
FIG. 7 is an enlarged cross-sectional view of a sealing member, a sidewall of the casing, and an ink extraction outlet.

Here, the ink extraction outlet 23 and the sealing member 24 will be described more in detail. As shown in FIG. 4(*a*), the ink extraction outlet 23 is formed integrally with a sleeve 23*a* and a flange 23*b*. The flange 23*b* has a ring shape and is attached to one end of the sleeve 23*a* to radially outwardly extend from the sleeve 23*a*. Both the sleeve 23*a* and the flange 23*b* are formed with a through hole 23*c* penetrating therethrough. As shown in FIG. 7, the through hole 23*c* has a wider cross section toward its one end.

As shown in FIG. 6, the sealing member 24 is integrally formed with a stopper portion 24*a* and an outer sleeve portion 24*b*. The stopper portion 24*a* has a smaller cross section toward its end, and tightly fits inside the through hole 23*c*. In this manner, a sealing portion between the ink extraction outlet 23 and the sealing member 24 where the inner surface, the outer surface, and a tip end surface of the sleeve 23*a* are all in intimate contact with the sealing member 24 has a relatively large area. This ensures the sealing between the ink extraction outlet 23 and the sealing member 24 and thus reliably prevents ink from leaking out of the ink cartridge 9.

As shown in FIG. 7, a protrusion 49 is formed on an inner periphery of the mounting hole 25. The protrusion 49 could be a single ring-shaped protrusion extending in a peripheral direction of the mounting hole 25 or could be a plurality of dots aligned in the peripheral direction. Accordingly, when the sealing member 24 is placed inside the mounting hole 25, the protrusion 49 presses the outer sleeve portion 24*b* of the sealing member 24 in a radially inward direction.

With this configuration, even when the needle 29 is inserted into or pulled out from the sealing member 24, the sealing member 24 is reliably prevented from disengaging from the mounting hole 25, thereby reliably preventing ink leakage. Moreover, because the protrusion 49 inwardly urges and compresses the sealing member 24, the intimate contact between the ink extraction outlet 23 and the sealing member 24 are improved, so that ink leakage is further reliably prevented.

In FIG. 2, provided on the side wall 20*d* near the mounting holes 25 and 26 is a memory chip 30 and electrical contact layout portion 31. The memory chip 30 stores such information as an ink type, applicable inkjet recording devices, and the ink cartridges' history of use. Once the ink cartridge 9 is mounted in a recording device, then the ink cartridge 9 is determined not a new product. The electrical contact layout portion 31 is for connecting the memory chip 30 to a circuit board of the inkjet recording device 1.

Figure 3:
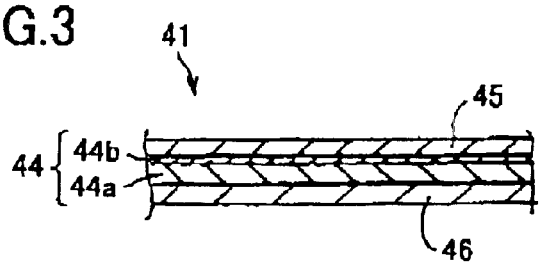
FIG. 3 is a cross-sectional view of a multilayer sheet.
Figure 4A:
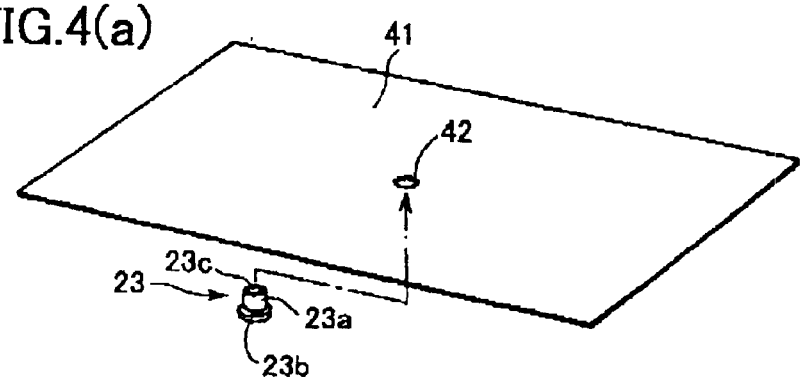
FIG. 4(*a*) is a perspective explanatory view of the sheet of FIG. 3 and an ink extraction outlet.
Figure 4B:
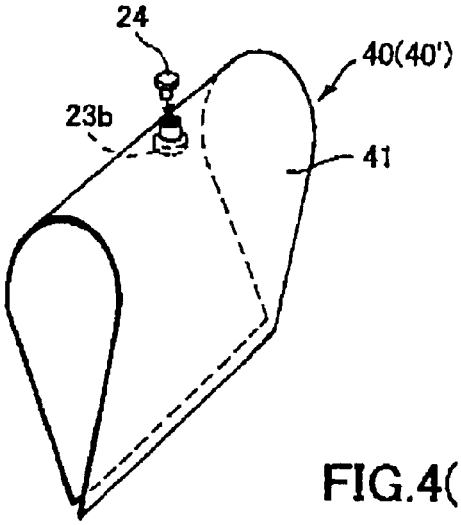
Figure 4C:
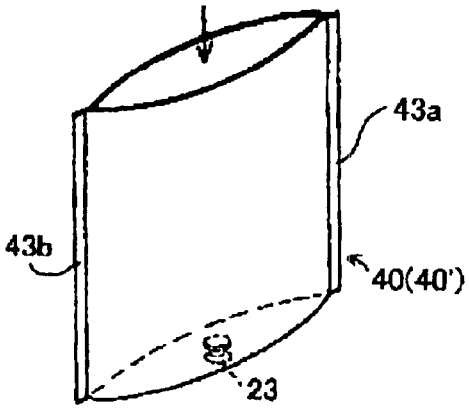
Figure 4D:
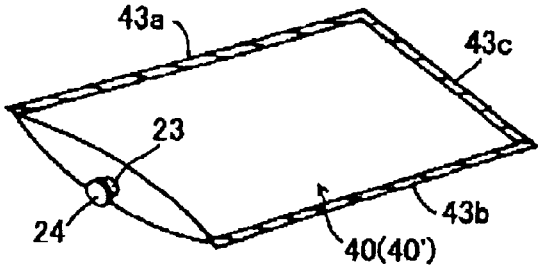

Next, processes of producing the ink accommodating pouch 40 will be described. First, a sheet 41 formed of a synthetic resinous material in a rectangular shape shown in FIG. 3 is prepared. The sheet 41 includes a vacuum deposition film 44 having a polyethylene terephthalate film 44*a* and an alumina or silica layer 44*b* formed by vacuum deposition on one surface of the polyethylene terephthalate film 44*a*. A nylon resin film 45 is bonded to a top surface of the vacuum deposition film 44, and a polypropylene resin or polyethylene film 46 is bonded to a bottom surface of the vacuum deposition film 44.

Next, as shown in FIG. 4(*a*), the sheet 41 is formed with a through hole 42 in the middle. The sleeve 23*a* of the ink extraction outlet 23 is inserted into the hole 42 from the film 46 side so that the flange 23*b* abuts the film 46. Then, the flange 23*b* is adhered to the sheet 41 by adhesive or heat sealing. Here, in the present embodiment, the ink extraction outlet 23 is formed of polypropylene resin or polyethylene so that the ink extraction outlet 23 and the heat sealing surfaces on the sheet 41 are formed of the same material in order to improve the sealability of the parts.

Then, as shown in FIG. 4(*b*), the sealing member 24 is engaged with the ink extraction outlet 23, and the sheet 41 is folded in haft such that the flange 23*b* locates inside. As shown in FIG. 4(*c*), right, left, and bottom edges are oriented in the same direction and overlap one another. The aligned right and left edges except the bottom edge are fused completely by heat (heat sealed) or an adhesive, thereby forming junctions (fused parts) 43*a*, 43*b* as shown in FIG. 4(*c*). The resultant product is filled with ink through the bottom opening, and then the bottom edges are fused by heat to form a junction 43*c* as shown in FIG. 4(*d*). In this manner, the ink accommodating pouch 40 is produced. Because the sealing surface of the sheet 41 is made of the Polypropylene resin or polyethylene film 46, the sealability of the junctions 43*a*, 43*b* are improved.

Thus produced ink accommodating pouch 40 is housed into the accommodating chamber 20*a*, and then the sealing member 24 is engaged inside the mounting hole 25 for sealing off the mounting hole 25. The cover 21 is adhered with an adhesive or the like to the casing 20 to form a hermetic seal. Once the ink in the ink accommodating pouch 40 is completely expended, the ink cartridge 9*d* is replaced.

Figure 8:
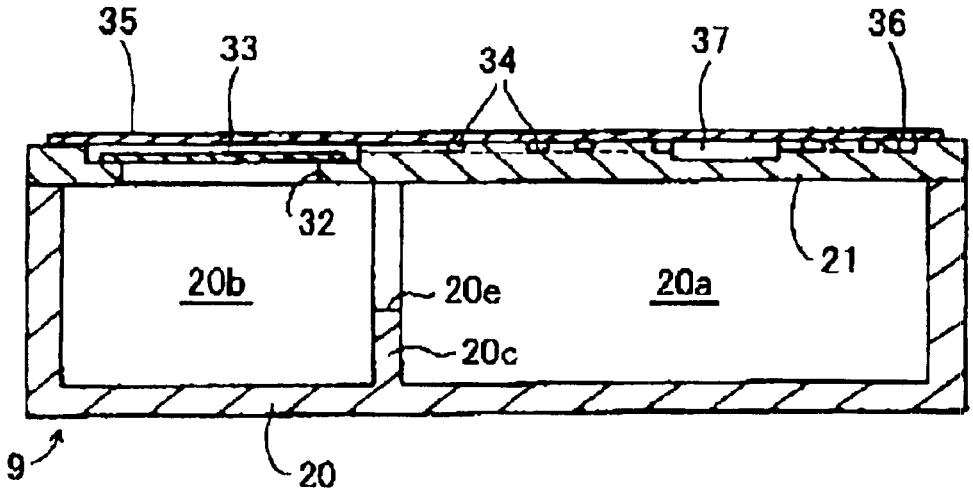
FIG. 8 is a cross-sectional view of the ink cartridge taken along a line VIII—VIII of FIG. 2 with the cover placed on the casing.

Next, the cover 21 will be described in detail. As shown in FIG. 2, the cover 21 is formed with a stepped opening 32, a thin labyrinth channel 34, and an ink trap 37. As shown in FIG. 8, an air permeable film 33 is adhered to a stepped portion 32*a* inside the stepped opening 32 for dividing the opening 32 into an outer space and an inner space. The air permeable film 33 allows air to pass through, but not fluid like ink. The thin labyrinth channel 34 is formed in a twisting and turning pattern in an outer surface of the cover 21 in fluid communication with the outer space of the opening 32. The labyrinth channel 34 has a cross-sectional dimension much smaller than that of the opening 32. The ink trap 37 having a wide surface area is formed as an indentation in the middle of the labyrinth channel 34.

An air non-permeable film 35 is adhered to the outer surface of the cover 21 to cover the entire stepped opening 32, the labyrinth channel 34, and the ink trap 37. The air non-permeable film 35 is not permeable to both air and liquid. The air non-permeable film 35 is formed with a penetrating hole 36 that connects an end of the labyrinth channel 34 to the external air.

With this configuration, air contained in the waste ink that is collected into the waste ink introducing chamber 20*b* is discharged out of the ink cartridge 9*d* through the stepped opening 32, air permeable film 33, the air non-permeable film 35, the ink trap 37, and the penetrating hole 36 while preventing the waste ink from leaking out of the ink cartridge 9*d*.

With this configuration, when defective ink is introduced into the waste ink introducing chamber 20*b* along with air through the needle 28, the air is discharged outside the casing 20 through the air permeable film 33, so that internal pressure of the casing 20 do not increase more than the ambient pressure. Also, when the temperature of the ink cartridge 9 increases, air inside the casing 20 can be discharged out of the casing 20, thereby preventing the internal pressure exceeding the ambient pressure. On the other hand, the collected defective ink is maintained inside the waste ink introducing chamber 20*b* because of the air permeable film 33.

Here, the ink trap 37 prevents ink from passing out through the labyrinth channel 34 in the unlikely event that ink leaks through the adhered surface of the air permeable film 33 attached to the stepped portion 32*a*. That is, because of the air non-permeable film 35, ink leaked through the adhered surface of the pair permeable film 33 when the ink cartridge 9 is placed upside down or on its side will pass through the labyrinth channel 34. However, the ink trap 37 can hold such a leaked ink, so that it is possible to discharge only air while preventing ink from leaking outside the ink cartridge 9*d*. This reliably prevents the ink from dirtying the inkjet recording device 1.

Here, the ink cartridge 9*d* is located below the nozzle surface of the print head 7. When there is a head difference H1 (mmAg) between an ink level in the ink cartridge 9*d* and the print head 7, it is preferable that the head difference H1 be greater than a maximum pressure H2 (mmAg) that the internal pressure of the ink cartridge 9 reaches when the purging operation is performed introducing waste ink into the ink cartridge 9*d* (H1>H2). This can be achieved by using a proper air permeable film 33. When such a pressure balance (H1>H2) is maintained, a meniscus will not project from the nozzle surface of the print head 7 during the purging operations, so the nozzle surface will not be dirtied.

As described above, according to the present invention, ink leakage is effectively prevented without needing an ink absorbing member for holding waste ink inside the ink cartridge 9. This reduces production costs and also the volume and weight of the ink cartridge 9*d*, which in turn provides compact-sized, light inkjet recording devices.

While some exemplary embodiments of this invention have been described in detail, those skilled in the art will recognize that there are many possible modifications and variations which may be made in these exemplary embodiments while yet retaining many of the novel features and advantages of the invention.

Figure 9:
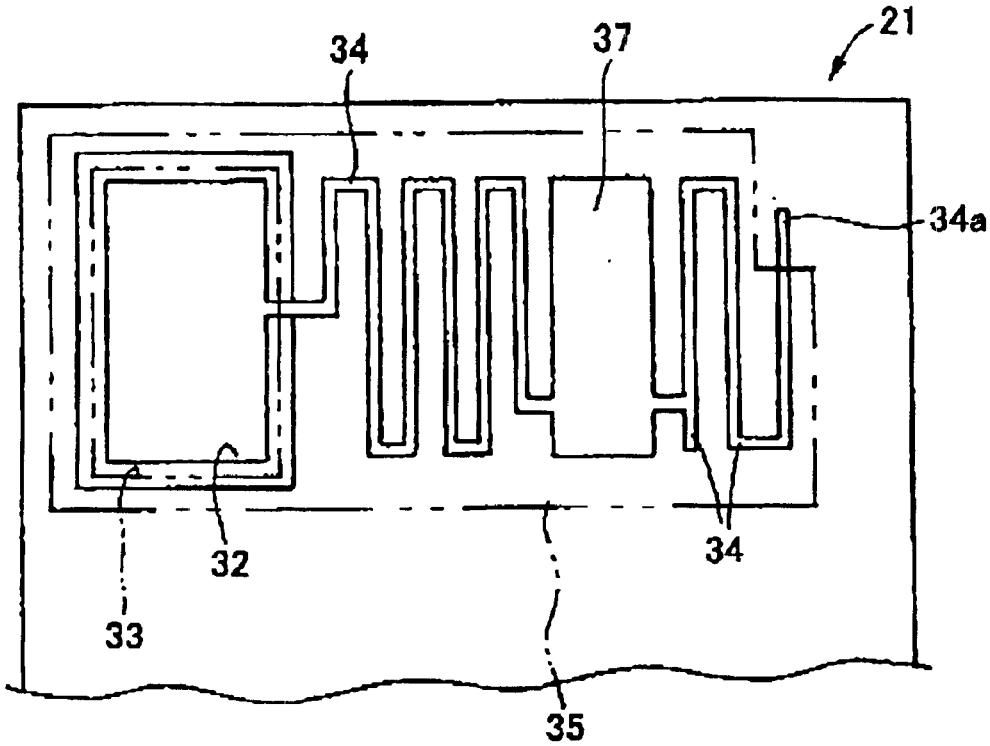
FIG. 9 is a plan view showing an attached position of a film covering over a stepped opening and a labyrinth channel formed in a cover according to a modification of the embodiment.

For example, instead of forming the through hole 36 in the non-permeable film 35 as shown in FIG. 2, the non-permeable film 35 can be formed with no through hole 36 but, as shown in FIG. 9, in a shape that allows an end 34*a* of the labyrinth channel 34 exposed to the air.

Also, the sealing member 27 could be provided in the cover 21 rather than the sidewall 20*d*. Further, the ink accommodating pouch 40 could be formed of two sheets as in conventional pouches. That is, the two sheets are overlapped each other and then their edges are fused by heat. Moreover, the flange 23*b* could be dispensed with as long as the ink extraction outlet 23 is formed with the through hole 23*c*.

Further, the opening 32 could not be a stepped opening. In this case, the air permeable film 33 may be attached on an internal surface of the cover 21. Further, the opening 32 and the labyrinth channel 34 could be formed in a bottom wall or one of side walls of the casing 20, rather than in the cover 21.

Moreover, waste ink could be discharged by applying a high pressure to the ink the print heads 7 rather than the purging operations that draws ink by generating a negative pressure in the print heads 7.

What is claimed is:

1. An ink housing device comprising:

a casing formed with an ink accommodating chamber for accommodating an ink accommodating pouch and a waste ink chamber into which a waste ink is collected, the casing is formed with a through hole connected to the waste ink chamber; and an air permeable film that seals the through hole.

2. The ink housing device according to claim 1, further comprising a non-permeable film attached to the casing, the non-permeable film being non permeable to air, wherein the casing is further formed with a labyrinth channel in an outer surface of the casing, the labyrinth channel having a smaller cross-sectional dimension than the through hole;

the non-permeable film is attached to the outer surface of the casing over the labyrinth channel and the air permeable film; and the labyrinth channel has one end connected to a portion of the through hole located outside the air permeable film and an opposite end exposed to ambient air.

3. The ink housing device according to claim 1, further comprising a partitioning wall placed inside the casing between the waste ink chamber and the ink accommodating chamber, the partitioning wall being formed with an opening that fluidly connects the waste ink chamber to the ink accommodating chamber.

4. The ink housing device according to claim 1, wherein the casing is provided with a sealing member through which a hollow needle for introducing the waste ink into the waste ink chamber is inserted.

5. The ink housing device according to claim 1, wherein the casing includes a main casing having an open surface and a cover that covers the open surface of the main casing, and the through hole is formed in the cover.

6. The ink housing device according to claim 1, wherein the casing includes a main casing having an open surface and a cover that covers the open surface of the main casing, the main casing having walls, and the through hole is formed in one of the walls of the main casing.

7. The ink housing device according to claim 1, wherein the air permeable film is attached to an inner surface of the casing.

8. The ink housing device according to claim 1, wherein the through hole is in a stepped shape, and the air permeable film is attached inside the through hole.

9. The ink housing device according to claim 1, wherein the air permeable film prevents ink from passing therethrough.

10. An inkjet recording device comprising:

an inkjet head;

an ink cartridge that includes an ink accommodating pouch accommodating ink, a casing formed with a waste ink chamber and an ink accommodating chamber that houses the ink accommodating pouch, and an air permeable film, the casing being formed with a through hole connected to the waste ink chamber, wherein the air permeable film seals the through hole;

a supply tube that introduces the ink from the ink accommodating pouch to the inkjet head; and a discharging tube that introduces a waste ink from the inkjet head into the waste ink chamber.

11. The inkjet recording device according to claim 10, wherein:

the ink cartridge further includes a non-permeable film attached to the casing, the non-permeable film being not permeable to air;

the casing is further formed with a labyrinth channel in an outer surface of the casing, the labyrinth channel having a smaller cross-sectional dimension than the through hole;

the non-permeable film is attached to the outer surface of the casing over the labyrinth channel and the air permeable film; and the labyrinth channel has one end fluidly connected to a portion of the through hole located outside the air permeable film and an opposite end exposed to ambient air.

12. The inkjet recording device according to claim 10, wherein the ink cartridge further includes a partitioning wall placed inside the casing between the waste ink chamber and the ink accommodating chamber, the partitioning wall being formed with an opening that fluidly connects the waste ink chamber to the ink accommodating chamber.

13. The inkjet recording device according to claim 10, wherein the casing is formed with another through hole engaged with a sealing member, and the discharging tube is mounted with a hollow needle on a tip end of the discharging tube, the hollow needle being inserted through the sealing member into the waste ink chamber.

14. The inkjet recording device according to claim 10, wherein the casing includes a main casing having an open surface and a cover that covers the open surface of the main casing, and the through hole is formed in the cover.

15. The inkjet recording device according to claim 10, wherein the casing includes a main casing having an open surface and a cover that covers the open surface of the main casing, the main casing having walls, and the through hole is formed in one of the walls of the main casing.

* * * * *